United States Patent [19]

Soerens

[11] Patent Number: 4,994,146

[45] Date of Patent: Feb. 19, 1991

[54] CREPING ADHESIVE UTILIZING POLYMER-POLYMER COMPLEX FORMATION

[75] Inventor: Dave A. Soerens, Neenah, Wis.

[73] Assignee: Kimberly-Clark Corporation, Neenah, Wis.

[21] Appl. No.: 263,926

[22] Filed: Oct. 28, 1988

[51] Int. Cl.[5] ..... D21H 25/04

[52] U.S. Cl. ..... 162/112; 162/164.6; 162/168.1; 162/184

[58] Field of Search ..... 162/111, 112, 168.1, 162/164.6, 164.1, 184; 264/283

[56] References Cited

U.S. PATENT DOCUMENTS

| | | | |
|---|---|---|---|
| 4,063,995 | 12/1977 | Grossman | 162/112 |
| 4,064,213 | 12/1977 | Lazorisak et al. | 162/112 |
| 4,125,659 | 11/1978 | Klowak et al. | 162/112 |
| 4,436,867 | 3/1984 | Pomplun et al. | 162/112 |
| 4,440,898 | 4/1984 | Pomplun et al. | 162/112 |
| 4,501,640 | 2/1985 | Soerens | 162/111 |
| 4,684,439 | 8/1987 | Soerens | 162/112 |

*Primary Examiner*—Peter Chin

*Attorney, Agent, or Firm*—Gregory E. Croft

[57] ABSTRACT

In the manufacture of creped tissue products, the adhesion between the tissue sheet and the creping cylinder can be increased by applying one component of an adhesive complex to the sheet and another component of an adhesive complex to the creping cylinder. When the two components are brought into contact at the pressure roll nip, an adhesive complex is formed which adheres the sheet to the creping cylinder.

20 Claims, 1 Drawing Sheet

CREPING ADHESIVE UTILIZING POLYMER-POLYMER COMPLEX FORMATION

BACKGROUND OF THE INVENTION

In the manufacture of tissue products and the like in which a wet laid fibrous web is dewatered, dried, and creped, it is common practice to apply a creping adhesive to the surface of the creping cylinder (such as a Yankee dryer) at a point just prior to pressing the web against the cylinder surface. For example, U.S. Pat. No. 4,684,439 to Soerens teaches creping adhesives containing polyvinyl alcohol and the reaction product of a polyalkylene polyamine, a saturated aliphatic dibasic carboxylic acid, and a poly(oxyethylene) diamine. U.S. Pat. No. 4,528,316 to Soerens and U.S. Pat. No. 4,501,640 to Soerens teach creping adhesives containing polyvinyl alcohol and cationic polyamide resins. U.S. Pat. No. 4,440,898 to Pomplun et al. teaches creping adhesives containing ethylene oxide/propylene oxide copolymers. U.S. Pat. No. 4,436,867 to Pomplun et al. teaches creping adhesives containing poly 2-ethyl-2-oxazoline and a high molecular weight thermoplastic polymer. In addition it has been disclosed to apply the creping adhesive at more than one location. See, for example, U.S. Pat. No. 4,064,213 to Lazorisak et al.

The chemical literature has reported polymer complex formulation between water-soluble polymers (see K. L. Smith, et al., Industrial and Engineering Chemistry, 51 (11), 1361, (1959); Y. Osada, Journal of Polymer Science: Polymer Chemistry Edition, 17, 3485, (1979); S. K. Chatterjee, et al., Die Angewandte Makromolekulare Chemie, 116, 99, (1983)). These complexes generally form as a result of very specific and very stable hydrogen bonds formed when the polymers make contact in solution. Complex formation is indicated by an increase in the viscosity of the combined solutions or the formation of a water-insoluble precipitate when solutions of the two polymers are combined. In particular, poly acids such as (poly)acrylic acid or (poly)methacrylic acid are reported to form complexes with poly ethers such as (poly)ethylene oxide and poly amides such as (poly)vinylpyrrolidone or (poly)ethyl oxazoline. However, there is no suggestion in these references that the polymer complexes can be created in situ during the creping of tissue.

SUMMARY OF THE INVENTION

It has now been discovered that the adhesion of a paper web to a creping cylinder (such as a Yankee dryer) can be enhanced by adhering the paper web to the creping cylinder with a polymer-polymer adhesive complex formed from at least two separately applied water-soluble polymeric components. One water-soluble polymeric component is applied to the creping cylinder and the other water-soluble polymeric component is applied to the paper web. When the paper web contacts the creping cylinder, as at the pressure roll nip, the adhesive complex is formed and adhesion of the web to the creping cylinder is achieved. Improved uniformity and control of creping is believed to result because, in contrast to conventional creping adhesives, both surfaces bonded together at the pressure roll nip are treated with water-soluble polymeric components having an affinity for the surface to which they are applied. Changes in adhesion due to variation in furnish or wet-end chemicals should be reduced.

In addition, in typical creping operations the adhesion of the web to the Yankee dryer is known to be strongly affected by drying conditions as a natural consequence of using water-soluble creping adhesives. The alternative of using water-insoluble creping adhesives is not feasible because of problems associated with contamination of the felt and/or fabric. However, this invention can combine the advantages of both water-soluble and water-insoluble creping aids because the water-soluble polymeric components which form the adhesive complex remain water-soluble until they come into contact with each other at the pressure roll nip and form the adhesive complex. Therefore the adhesive bond itself is less water-sensitive while the materials used to form the adhesive bond remain water-soluble and thus minimize fabric/felt contamination problems.

Hence, in one aspect the invention resides in an improved method for making creped tissue wherein a tissue web is adhered to a creping cylinder and dislodged therefrom with a doctor blade, the improvement comprising adhering the web to the creping cylinder with an adhesive complex wherein a water-soluble polymeric component of the adhesive complex is applied to the surface of the creping cylinder and another water-soluble polymeric component of the adhesive complex is applied to the surface of the web such that the adhesive complex is formed when the web is brought into contact with the creping cylinder.

For purposes herein, "water-soluble" means that the polymers dissolve completely in water to give a true solution as opposed to a latex or suspension of undissolved particles.

In order for the adhesive complex to function effectively, it is necessary that the water-soluble polymeric component applied to the creping cylinder surface have an affinity for that surface. Likewise, the water-soluble polymeric component applied to the paper web must have an affinity for the fibers making up the web. Otherwise the web will not be adequately adhered to the creping cylinder.

The water-soluble polymeric component applied to the creping cylinder surface preferably is an aqueous solution of a polyacid or a mixture of a polyacid and another water-soluble polymer. Suitable polyacids include polyacrylic acid ("PAA"), polymethacrylic acid, methyl vinyl ether-maleic acid copolymer, ethylene maleic acid copolymer, ethylene acrylic acid copolymer, ethylene methacrylic acid copolymer, styrene maleic acid copolymer, and the like. Number average molecular weights for these components should be from about 10,000 to about 500,000.

The water-soluble polymeric component applied to the web is preferably an aqueous solution of a polyether, a polyamide, or a mixture of one or both with another water-soluble polymer. Suitable polyethers include (poly)ethylene oxide ("POLYOX"), (poly)propylene oxide, ethylene oxide/propylene oxide copolymers, (poly)tetra methylene oxide, poly vinyl methyl ether, and the like. Suitable polyamides include (poly)vinylpyrrolidone, (poly)ethyl oxazoline ("PEOX"), (poly)amidoamine, (poly)acrylamide, polyethylene imine, and the like. Number average molecular weights for these components should be from about 10,000 to about 500,000.

Other water-soluble polymers which can be mixed with either of the water-soluble polymeric components used to form the adhesive complex include polyvinyl alcohol (PVA), carboxyl methyl cellulose, hydroxypropyl cellulose, and the like.

DETAILED DESCRIPTION OF THE DRAWING

Figure 1:
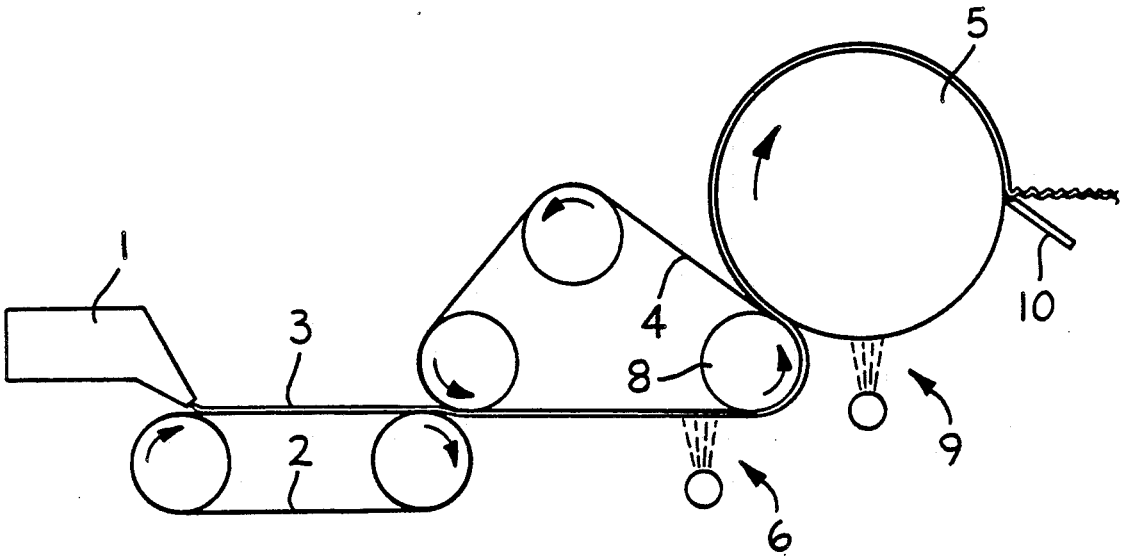
FIG. 1 schematically shows a typical tissue-making process and illustrates locations suitable for separately applying the two water-soluble polymeric components in accordance with this invention.

Directing attention to the Drawing, the invention will be described in more detail. Represented in FIG. 1 is a schematic drawing of a basic tissue-making process in which the practice of the method of this invention is illustrated. Shown is a headbox 1 which serves to deposit an aqueous slurry of papermaking fibers onto a continuous forming fabric or wire 2. Water passes through the wire leaving a wet fibrous web 3 on the surface of the wire. The wet web is transferred to another continuous fabric or felt 4 which serves to further dewater the web. It will be appreciated by those skilled in the art that a great many variations in the tissue-making process are possible and FIG. 1 is presented only for the purpose of placing the method of this invention in context.

Prior to being adhered to the creping cylinder 5 or Yankee dryer, the web is sprayed 6 with an aqueous solution of one water-soluble polymeric component of the adhesive complex. This can be done at any point in the process prior to the web contacting the surface of the creping cylinder. The spray can also be directed into the nip between the pressure roll 8 and the creping cylinder. The other water-soluble polymeric component is applied to the surface of the creping cylinder, as by a spray 9 as shown at the 6 o'clock position. When the web contacts the creping cylinder in the pressure roll nip, the adhesive complex components react to form the adhesive complex, which adheres the web to the creping cylinder. The web is subsequently dislodged from the creping cylinder by a doctor blade 10, resulting in a creped web.

Webs particularly suitable for purposes of this invention include tissues, towels, and the like which have basis weights of from about 3 to about 40 pounds per 2880 square feet. Cellulosic webs are preferred, but webs containing synthetic fibers can also be used.

EXAMPLES

Example 1

Peel Adhesion

The increase in adhesion between a web and a surface achieved by the adhesive complex in accordance with this invention was illustrated by a laboratory test method performed as follows. A series of cast iron plates measuring 2 inches by 5 inches by 0.25 inches thick was coated with an aqueous mixture of polyvinyl alcohol (Elvanol 7515 manufactured by E. I. duPont, Wilmington, DE) and polyacrylic acid (Alcosperse 404 manufactured by Alco Chemical Corporation, Chattanooga, TN). The mixture, at 10 weight percent solids, was applied with a rod tightly wound with #26 wire and allowed to air dry at room temperature. Various blend ratios were used as shown in Table 1 below. The coated cast iron plate simulates the surface of the creping cylinder with one component of the adhesive complex applied.

A cotton cloth was used to simulate the tissue web. The cloth was soaked either in deionized water, as a control, or in dilute solutions of either of two water-soluble polymers which form a complex with polyacrylic acid, i.e. (poly)ethyloxazoline (grade 500 manufactured by Dow Chemical Corporation, Midland, MI) or (poly-)ethylene oxide (WSR-N80 manufactured by Union Carbide, Danbury, CT). Excess moisture was squeezed from the cloth strip and the strip was applied to the coated plate and rolled down with a 10 pound roller. The adhered sample was then placed on a hot plate and dried until the cloth surface reached a temperature of 180° F. The sample was immediately transferred to an Instrumentors Slip/Peel tester and the 180 degree peel adhesion was measured at 12 inches per minute. The average adhesion over a 1 inch peel distance was recorded. The average of 5 or 6 replicates of each combination of plate coating and soak solution are recorded in Table 1 below.

TABLE 1

| Plate Coating Composition (% PAA/% PVA) | Peel Adhesion (grams/2 in width) Cloth Soak Composition (WATER) | (.5% PEOX) | (1% PEOX) | (.5% POLYOX) |
|---|---|---|---|---|
| 100/0 | 232 | 339 | 385 | 253 |
| 80/20 | 331 | 378 | 513 | 395 |
| 60/40 | 378 | 558 | 615 | 568 |
| 40/60 | 499 | 540 | 518 | 523 |
| 20/80 | 348 | 369 | 348 | 536 |

As Table 1 shows, the addition of the complex-forming component to the soak solution increases the adhesion above the water control value in each case. Also, the magnitude of the adhesion enhancement varies with the amount of polyacrylic acid in the plate composition, the largest increase being observed with the 60/40 blend of PAA/PVA. For this blend a 48% increase is found with 0.5% PEOX, a 63% increase with 1% PEOX, and a 50% increase with 0.5% POLYOX. In general, the most favorable ratios for adhesive complex formation would be one repeat unit of acrylic acid to one repeat unit of the second polymer. Therefore, the best conditions will vary with the molecular weight of each complexing component.

Example 2

Peel Adhesion

Sixty (60) grams of methyl vinyl ether-maleic anhydride copolymer was slurried in 600 grams of water and shaken overnight to hydrolyze it to the water-soluble di-acid form. The pH of the 10% solution was found to be 1.94.

The 10% solution of hydrolyzed methyl vinyl ether-maleic anhydride copolymer (Ganting AN 149 made by GAF Corporation, New York, NY) was combined with an aqueous solution of PVA (Elvanol 75-15), also at 10% solids, in the proportions shown in Table 2 below. These blends were coated onto the cast iron panels. The cloth strips were soaked in PEOX or water. The cloth strips were tested for peel adhesive as previously described. The results are shown in Table 2 below.

TABLE 2

| Plate Composition (% PVA) | Peel Adhesion (grams/2 inch width) Cloth Soak Composition (WATER) | (1% PEOX) | (% INCREASE) |
|---|---|---|---|
| 100/0 | 108 | 135 | 25% |
| 80/20 | 133 | 173 | 30% |
| 60/40 | 173 | 237 | 37% |
| 40/60 | 188 | 261 | 39% |
| 20/80 | 215 | 245 | 14% |

This system again demonstrates increased adhesion as a result of complex formation between the polyacid and the PEOX.

Example 3

Peel Adhesion (Reverse Application of Components)

In order to illustrate the effect of reversing the application of the adhesive complex components, the above-described test procedure was repeated with the following combinations:

(a) PEOX/PVA blends coated onto the cast iron panels and the cotton cloth soaked in water or a solution of 1% PAA (Acrysol A-1 manufactured by Rohm and Haas Corporation, Philadelphia, PA).

(b) A blend of a cationic polyamide resin (Kymene manufactured by Hercules, Inc., Wilmington, DE) and PVA coated onto the cast iron panels and the cotton cloth soaked in water or a solution of 1% PAA.

(c) A blend of PEOX and PVA coated onto the cast iron panels and the cotton cloth soaked in water or a solution of 1% PAA. The results are set forth in Table 3 below.

TABLE 3

| Plate Composition | Peel Adhesion (grams/2 inch width) Cloth Soak Composition (WATER) | (1% PAA) | (% DECREASE) |
|---|---|---|---|
| (% PEOX/% PVA) | | | |
| 50/50 | 282 | 246 | 13% |
| 30/70 | 381 | 267 | 30% |
| 10/90 | 411 | 358 | 13% |
| (% Kymene/% PVA) 33/67 | 184 | 163 | 11% |
| (% PEOX/% PVA) 20/80 | 243 | 214 | 12% |

As clearly shown in Table 3, with the polyacid applied to the cloth the adhesion is reduced relative to the water control. This is believed to be due to poor anchorage of the acid polymer to the cloth. When these samples were peeled apart a white film was present, indicating complex formation. However, because of the poor anchorage the failure point was between the complex and the cotton cloth.

Example 4

Continuous Production of Facial Tissue

Facial tissue was prepared by wet-laying a web of papermaking fibers (50/50 northern softwood kraft-/eucalyptus) which had been treated with 0.25% wet strength resin (Kymene). The basis weight was 7.5 pounds/2880 ft.$^2$. The web was dewatered and pressed onto a Yankee dryer with a pressure roll. Prior to pressing onto the Yankee dryer the web surface was sprayed with a dilute solution of one of the polymeric adhesive complex forming components. The amount applied was equivalent to either 1 or 3 pounds per ton of dry fiber. Also, several samples were run in which no spray was applied to the web surface. In these cases the wet strength resin added at the wet end acts as the polymer complex forming component.

The other component for forming the adhesive complex was applied to the Yankee dryer at a 6 o'clock position at add-on rate of about 5 pounds/ton of dry fiber. The adhesive complex forming component was applied to the Yankee dryer as an aqueous blend with various amounts of polyvinyl alcohol, which provides enhanced film forming properties on the Yankee dryer. The resulting creped tissue products were submitted to a trained sensory panel for an evaluation of softness. Higher sensory panel numbers correspond to greater softness.

The combinations run and the resulting sensory panel softness values are shown in Table 4 below.

TABLE 4

| Dryer Surface Composition | Facial Tissue Softness Sheet Surface Composition | Amount (pounds/ton) | Softness |
|---|---|---|---|
| 40PVA/60PAA | NONE (control) | — | 7.2 |
| 40PVA/60PAA | POLYOX | 3 | 7.65 |
| 40PVA/60PAA | PEOX | 1 | 7.8 |
| 40PVA/60PAA | PEOX | 3 | 8.0 |
| 8OPVA/20PMA[1] | NONE (control) | — | 7.7 |
| 80PVA/20PMA | POLYOX | 1 | 8.15 |
| 80PVA/20PMA | POLYOX | 3 | 8.05 |
| 80PVA/20PMA | PEOX | 1 | 8.05 |
| 80PVA/20PAA | NONE (control) | — | 8.08 |
| 80PVA/20PAA | POLYOX | 3 | 8.2 |
| 80PVA/20PAA | PEOX | 3 | 7.85 (high strength) |
| 40PVA/60PMA | NONE (control) | — | 8.1 |
| 40PVA/60PMA | POLYOX | 1 | 8.1 |
| 40PVA/60PMA | PEOX | 1 | 7.8 (high strength) |

[1]PMA = polymethacrylic acid, prepared by the addition of sulfuric acid to Aquatreat 225 (sodium salt of polymethacrylic acid) to a pH of 2.8. Aquatreat 225 is a product of Alco Chemical, Chattanooga, TN.

The results generally confirm an increase in softness with increasing adhesion, although there are some inconsistencies. Note that the examples above with no addition to the sheet surface can still have some complex formation by interaction with the wet-end applied Kymene. Therefore these controls are not quite the same as the laboratory controls where no complex formation was possible. Note also that addition of PEOX to the sheet surface tended to result in tissue samples of higher strength. This increased strength was reflected in lower softness relative to the control samples. If the samples were normalized to equivalent strengths, these samples would exhibit softness values of about 8.1.

Nevertheless, the method of this invention can increase the adhesion between the tissue sheet and the creping cylinder such as to improve the softness of the resulting product. At the same time, certain processing advantages can be obtained, such as more uniform creping control.

It will be appreciated that the foregoing examples, shown for purposes of illustration, are not to be construed as limiting the scope of this invention, which is defined by the following claims.

I claim:

1. In a method for making creped tissue wherein a tissue web is adhered to a creping cylinder and dislodged therefrom with a doctor blade, the improvement comprising adhering the web to the creping cylinder with an adhesive complex wherein a first water-soluble component of the adhesive complex is applied to the surface of the creping cylinder and a second water-soluble component of the adhesive complex is applied to the surface of the web such that the adhesive complex is formed when the web is brought into contact with the creping cylinder, said first component comprising a polyacid selected from the group consisting of polyacrylic acid, polymethacrylic acid, ethylene maleic acid copolymer, ethylene acrylic acid copolymer, ethylene methacrylic acid copolymer, styrene maleic acid copolymer, and mixtures thereof and said second component being selected from the group consisting of a polyether, a polyamide, and mixtures thereof.

2. The method of claim 1 wherein the polyacid is a mixture of polyvinyl alcohol and polyacrylic acid.

3. The method of claim 1 wherein the polyacid is a mixture of polyvinyl alcohol and polymethacrylic acid.

4. The method of claim 1 wherein the polyacid comprises methyl vinyl ether-maleic acid copolymer.

5. The method of claim 1 wherein the polyacid comprises polyacrylic acid.

6. The method of claim 1 wherein the polyacid comprises polymethacrylic acid.

7. The method of claim 1 wherein the polyether is (poly) ethylene oxide.

8. The method of claim 1 wherein the polyether is (poly)propylene oxide.

9. The method of claim 1 wherein the polyether is ethylene oxide/propylene oxide copolymer.

10. The method of claim 1 wherein the polyether is (poly)tetramethylene oxide.

11. The method of claim 1 wherein the polyether is poly vinyl methyl ether.

12. The method of claim 1 wherein the polyamide is (poly) vinylpyrrolidone.

13. The method of claim 1 wherein the polyamide is (poly)ethyl oxazoline.

14. The method of claim 1 wherein the polyamide is (poly)amidoamine.

15. The method of claim 1 wherein the polyamide is (poly)acrylamide.

16. The method of claim 1 wherein the polyamide is polyethylene imine.

17. The method of claim 1 wherein the polyacid is a mixture of polyvinyl alcohol and polyacrylic acid and wherein said second component is (poly) ethyl oxazoline.

18. The method of claim 1 wherein the polyacid is a mixture of polyvinyl alcohol and polyacrylic acid and wherein said second component is (poly)ethylene oxide.

19. The method of claim 1 wherein the polyacid is a mixture of polyvinyl alcohol and poly methacrylic acid and wherein said second component is (poly)ethyl oxazoline.

20. The method of claim 1 wherein the polyacid is a mixture of polyvinyl alcohol and polymethacrylic acid and wherein said second component is (poly)ethylene oxide.

* * * * *